United States Patent [19]

Rohr et al.

[11] Patent Number: 5,051,678

[45] Date of Patent: Sep. 24, 1991

[54] DRIVE DEVICE FOR A RECIPROCATING PART

[75] Inventors: Gunter Rohr, Hemmingen; Wolfgang Norz, Schwieberdingen; Horst Pordzik, Gerlingen, all of Fed. Rep. of Germany

[73] Assignee: 501 Union Special G.M.B.H., Stuttgart, Fed. Rep. of Germany

[21] Appl. No.: 490,780

[22] Filed: Mar. 8, 1990

Related U.S. Application Data

[63] Continuation of Ser. No. 268,817, Nov. 8, 1988, Pat. No. 4,967,674.

[30] Foreign Application Priority Data

Dec. 19, 1987 [DE] Fed. Rep. of Germany ..... 3743281
May 20, 1989 [DE] Fed. Rep. of Germany ..... 3744852

[51] Int. Cl.[5] ..... H02P 8/00

[52] U.S. Cl. ..... 318/696; 318/685; 112/121.11; 235/472

[58] Field of Search ..... 318/696, 685; 112/121.11, 121.12, 459; 235/472

[56] References Cited

U.S. PATENT DOCUMENTS

| | | | |
|---|---|---|---|
| 4,235,176 | 11/1990 | Yamashita et al. | 112/459 |
| 4,404,509 | 9/1983 | Hartwig | 318/685 |
| 4,496,831 | 1/1985 | Swartz et al. | 235/472 |

*Primary Examiner*—William M. Shoop, Jr.
*Assistant Examiner*—Saul M. Bergmann
*Attorney, Agent, or Firm*—Morgan & Finnegan

[57] ABSTRACT

A drive device for a reciprocating part having a part which is connected to a stepping motor whose direction of rotation can be changed. The stepping motor is reciprocatingly actuated in a single step length between no more than two step positions, such that it is possible to move the reciprocating part backwards and forwards in a predetermined manner in a simple and reliable way.

5 Claims, 4 Drawing Sheets

DRIVE DEVICE FOR A RECIPROCATING PART

CROSS REFERENCE TO RELATED APPLICATION

This application is a continuation of Ser. No. 268,817, filed Nov. 8, 1988 now U.S. Pat. No. 4,967,674.

BACKGROUND OF THE INVENTION

The present invention relates to drive devices for reciprocating parts.

Drive devices by a motor are sometimes necessary for driving reciprocating parts, such as for reciprocating feed dogs for a sewing machine. However, prior devices of this sort are unduly complex and suffer from reliability, and it is desirable to improve the operation and construction of such devices.

SUMMARY OF THE INVENTION

A principal feature of the present invention is the provision of an improved drive device for reciprocating parts.

The drive device comprises a stepper motor connected to a reciprocating part, with the stepper motor being of the type in which the direction of rotation can be changed.

A feature of the invention is that the stepper motor is reciprocatingly actuated in a single step length between no more than two step positions.

Another feature of the invention is that it is possible in the device to move the part backwards and forwards in a predetermined manner.

Yet another feature of the invention is that the part is moved in a simplified and reliable way.

In one form, the stepper motor may comprise a two-phase stepping motor in which direct voltage is applied to one phase and current is supplied to the other phase through two driver stages, with the direct stages advantageously being controlled by a bistable element.

Another feature of the invention is that the two-phase stepping motor is of cost-effective construction.

In another form, transmission elements may be provided between the stepping motor and the reciprocating part such as by including a crank arm.

Yet another feature of the invention is that the device provides a simple mechanical transmission of the step length of the stepping motor.

Further features will be more fully apparent in the following description of the embodiments of this invention and from the appended claims.

DESCRIPTION OF THE PREFERRED EMBODIMENTS

Figure 1:
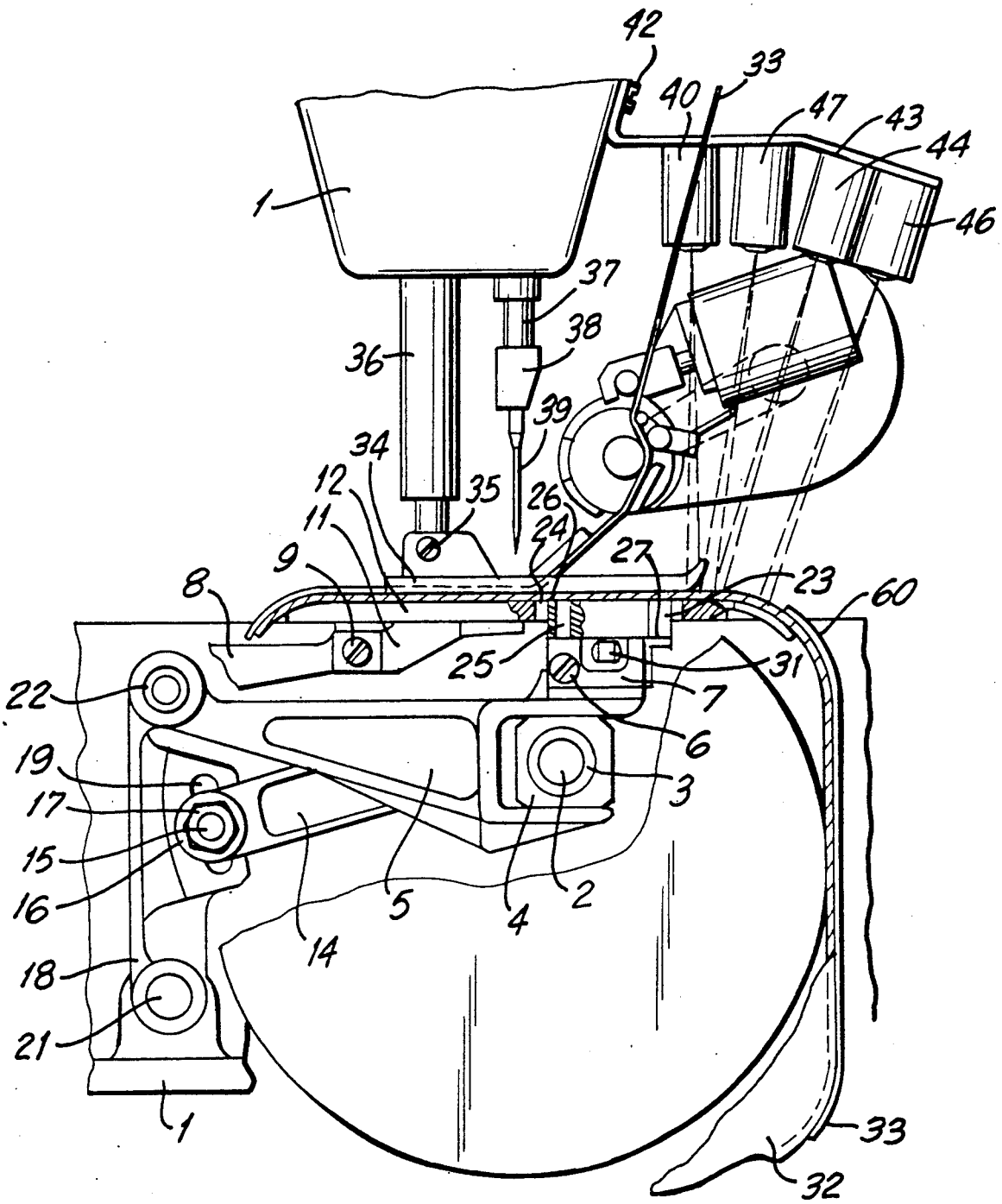
FIG. 1 is a side elevational view of a sewing machine of the present invention taken partly in section.
Figure 2:
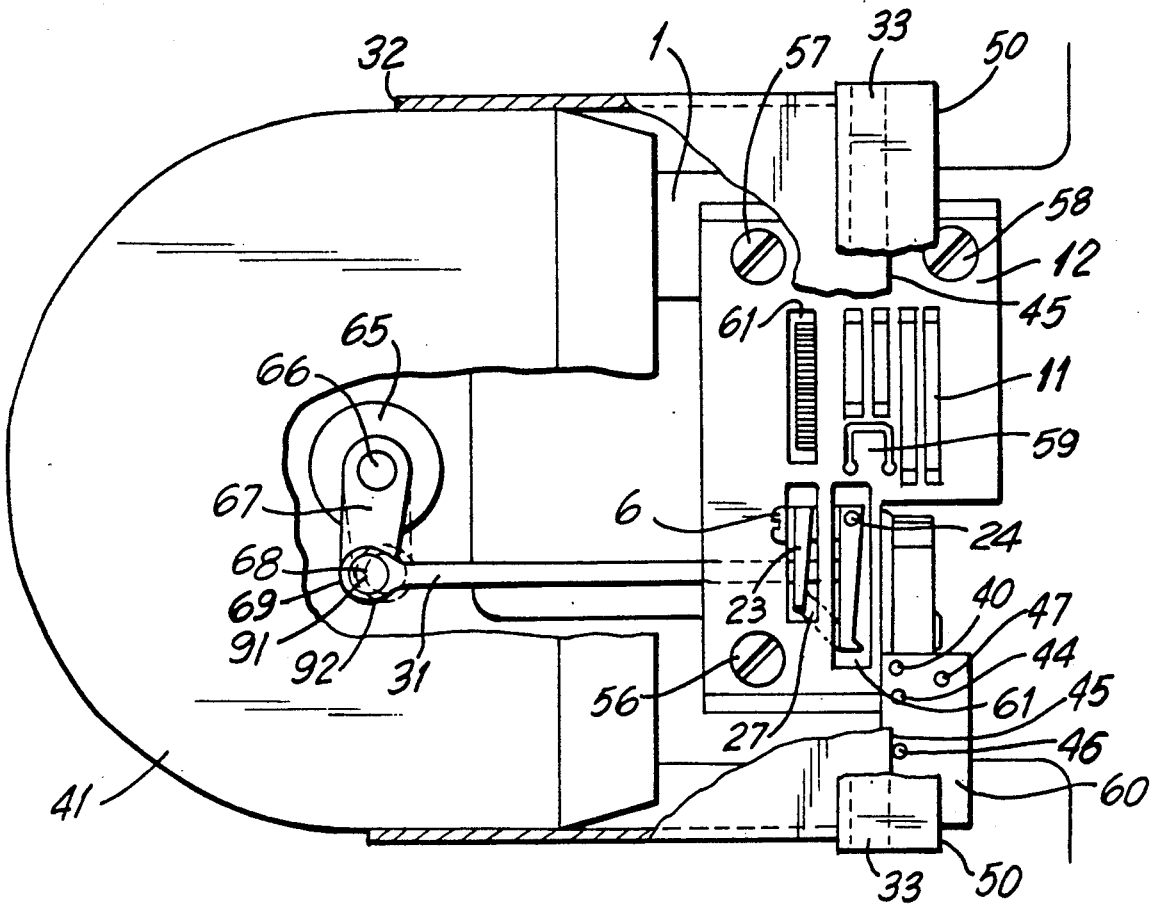
FIG. 2 is a top plan view of the sewing machine taken partly in section.

The present invention is described below in connection with a special reciprocating feed dog for a sewing machine, but it should be understood that the device has more general application for reciprocating driven parts of any type.

Referring now to FIGS. 1–4, there is shown a sewing machine having a housing 1 in which is journalled a shaft 2, which carries a lifting eccentric 3. The lifting eccentric 3 is surrounded by a slide block 4 which is mounted in a feed dog carrier 5. An intermediate holder 7 is fastened to the feed dog carrier 5 by a screw 6 in such a way that its height is adjustable.

A feed dog 11, which is driven in a known manner and which engages through a needle plate 12, is fastened by a screw 9 to a further feed dog carrier 8.

Figure 3:
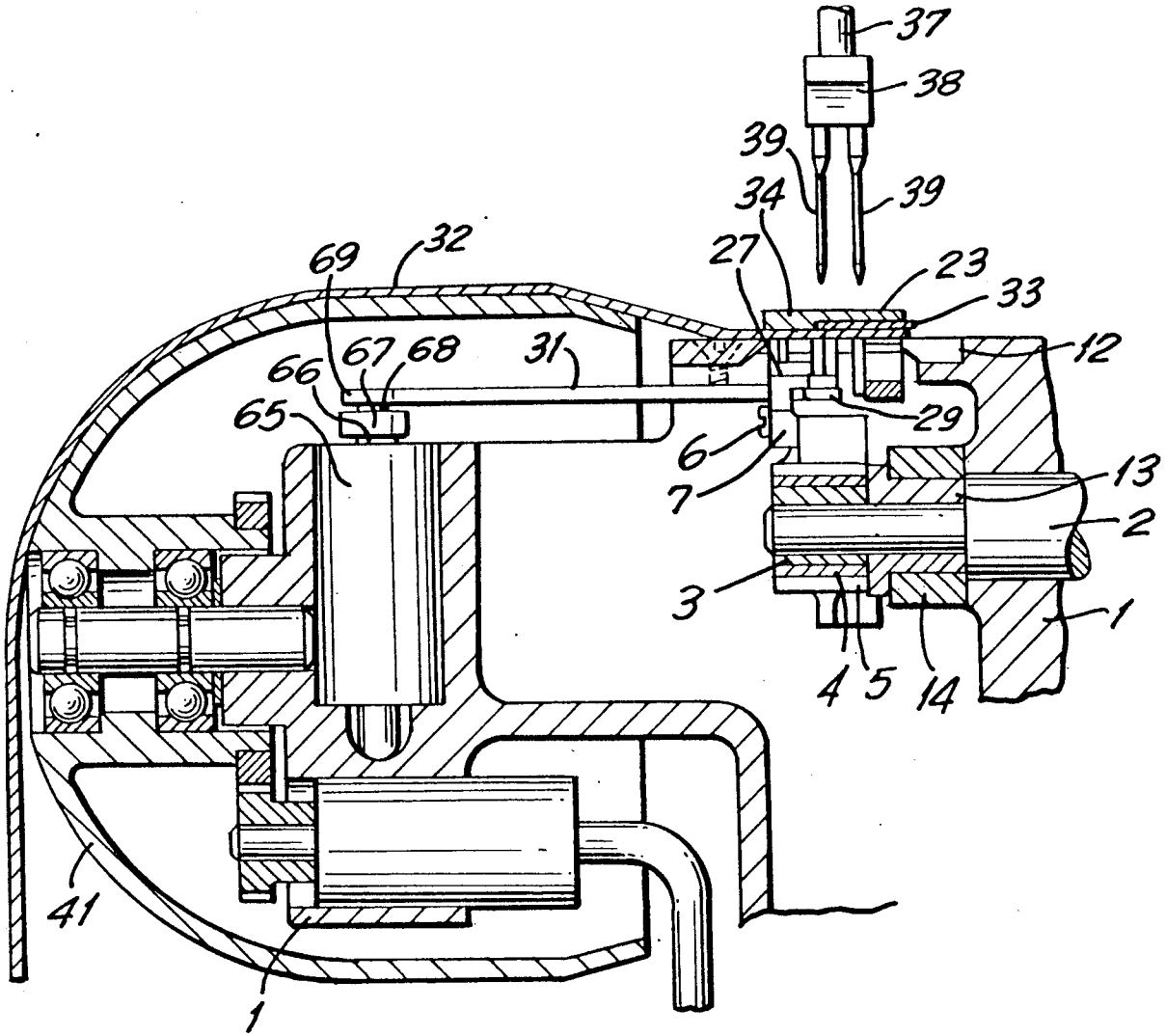
FIG. 3 is a front sectional view of the sewing machine.
Figure 4:
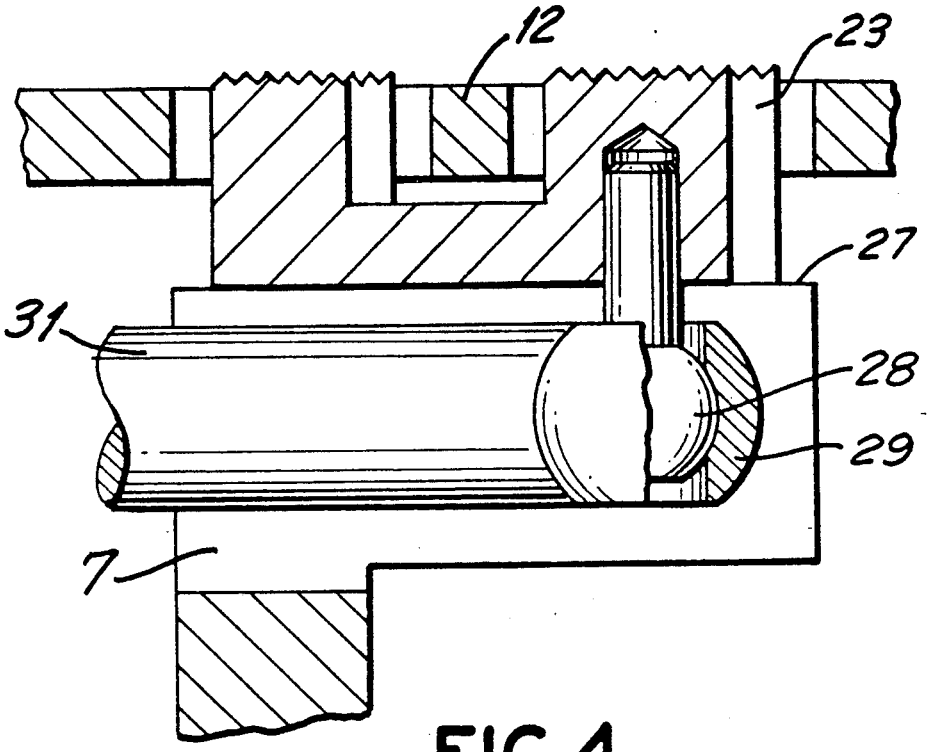
FIG. 4 is a fragmentary sectional view on an enlarged scale showing a pivot drive of an additional feed dog of FIG. 3.

A link 14, which is driven by way of the shaft 2 and a stroke eccentric 13, as best shown in FIG. 3, is articulated to a frame 18 by means of a stud 15, a disc 16 and a nut 17. The frame contains an oblong hole 19 through which the stud 15 projects. Altering the position of the stud 15 in the oblong hole 19 alters the magnitude of feed movement of the feed dog carrier 5. A shaft 21, which is fixed to the housing, pivots the frame 18 to the housing 1. The feed dog carrier 5 is pivoted to the free end of the frame 18 by means of a hollow shaft 22.

The intermediate holder 7 carries an additional feed dog 23, which is pivotally mounted in a rotary guide 24, which is formed by a stud bolt 25 and an opening 26 in the additional feed dog 23. A support face 27 on the intermediate holder 7 carries the additional feed dog 23, which can be moved in the plane of sewing and to which is fastened a ball stud 28, which is surrounded by a spherical shell 29 disposed on one end of a transverse link 31.

The additional feed dog 23, which projects through the needle plate 12, acts on the inside of a tubular elastic workpiece, to which is being sewn a tape 33 from a supply to form an endless band.

A material presser foot 34, which is opposite the two feed dogs 11 and 23, is fastened by a screw 35 to a presser bar 36, which is resiliently mounted in the housing 1. A needle head 38, which carries one or more needles 39, is fastened to a needle bar 37, which can move up and down. A guide member 41, at least part of which is surrounded by the workpiece 32, allows additional prior alignment of the workpiece 32.

A holder is fastened to the housing 1 by a screw 42 and carries a sensor 40 for detecting the edge 45 of an opening of the workpiece 32, a sensor 44 for detecting the leading end of the seam or tape on the workpiece 32, which has already been sewn, a sensor 46 for auxiliary controlled prior alignment of the workpiece 32, and a sensor 47 for detecting the edge of the opening of the tape 33.

The sensors 40, 44, 46, and 47 are in the form of light compartments, whose rays are reflected by a reflector plate 60. The needle plate 12 is attached by screws 56, 57 and 58 to the housing 1 and has a stitch formation point 59 and slots 61, through which the feed dog 11 and the additional feed dog 23 engage.

Figure 5:
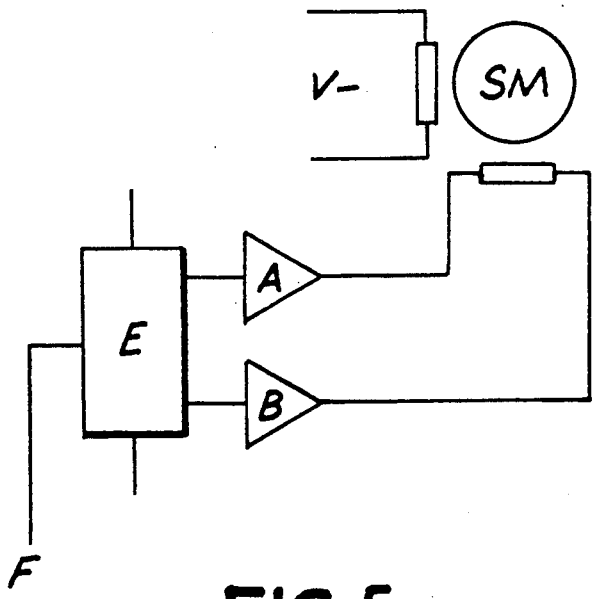
FIG. 5 is a block diagram of a stepping motor control for the sewing machine.

An electrically driven stepping motor (SM) 65, whose direction of rotation can be changed and which is controlled by the sensor 40 and a circuit shown schematically in FIG. 5, has a shaft 66, to which is connected a crank arm 67 so as to be non-rotatable. A ball stud 68 on the crank arm 67 is surrounded by a spherical shell 69, which is disposed on the other end of the transverse link 31.

As shown in FIG. 5, a direct voltage V− is applied to one phase of the two-phase stepping motor SM (stepping motor 65) of the sewing machine. Current is fed to the second phase through two driver stages A and B, which are in turn controlled by a bistable element E. The bistable element E is in turn synchronously controlled and has a logic signal input F. The control of the stepping motor 65 ensures that a mechanical movement of the additional feed dog 23 is in synchronism with the electronic control of the stepping motor 65, whereby it is also ensured that the stepping motor 65 can be repeatedly reciprocated between only two step positions 91 and 92. Known controls for two-phase stepping motors usually have four driver stages for supplying current to the two phases of the stepping motor 65. The series-connected electronic control which is required for this does not guarantee that the stepping motor 65 only takes up the two necessary step positions 91 and 92, since, depending on the input of the logic signals, these controls also allow the stepping motor to be further switched electrically into an unwanted step position.

The illustrated embodiment of the sewing machine operates as follows:

A known position motor drives the sewing machine in an operating cycle, which sewing machine has known devices for raising the presser foot, severing the sewing thread and positioning the needle 39. The tubular workpiece 32 to be sewn is inserted under the presser foot 34 and the leading end of the tape 33. Then the operating cycle is started, that is the presser foot 34 is lowered and the feed dogs 11 and 23 feed the workpiece 32 in the workpiece feed direction (direction of sewing). The sensor 40 scans the edge 45 of the opening of the workpiece 32.

If the sensor 40 detects the workpiece 32, the stepping motor 65 is given the command to pull the additional feed dog 23 towards the guide member 41 by means of the transverse link 31 after it has emerged at the top from the slots 61 in the needle plate 12. If it does not detect the workpiece 32, the stepping motor 65 is given the command to push the additional feed dog 23 away from the guide member 41 by means of the transverse link 31.

During or following dipping of the additional feed dog 23 below the surface of the needle plate 12, the light compartment 40 gives the stepping motor 65 either the control command "step position 91" or "step position 92". If it is already in the appropriate step position, it does not move while the additional feed dog 23 is below the surface of the needle plate 12, if it is not yet in the appropriate step position, it moves into it. When the shaft 2 has completed a predetermined, adjustable angle of rotation, for example 170 degrees, the stepping motor 65 initiates a pivoting movement into the other step position, that is, when the additional feed dog 23 has been applied to the workpiece 32 after it has emerged at the top through the slots 61 in the needle plate 12. This causes a lateral alignment movement of the workpiece 32.

Only one sensor 40 is required for this type of control using two step positions 91 and 92 of the stepping motor 65, and this provides for a simple solution, since there is no alignment movement of the additional feed dog 23 in either step position 91 or step position 92 when the control command is suppressed.

It is also possible to scan the edge 45 of the opening of the workpiece 32 between two adjacently disposed sensors. In doing so, the control command to move the additional feed dog 23 laterally may be suppressed as long as the edge 45 of the opening of the workpiece 32 moves laterally only between the two sensors.

When controlling the additional feed dog 23, it is thus important that the stepping motor 65 is moved forwards or backwards within a single step length. It has been found that this single step length is sufficient for functional control of the additional feed dog 23. This drive and this control of the additional feed dog 23, which causes transverse feed of the workpiece 32, with the aid of the multiple-phase stepping motor 65, which is driven backwards and forwards within a single step by only two driver stages A,B, are suitable not only for the above described sewing machine for sewing on a tape, but also generally for reciprocatingly driven devices of any type. In general, this provides the advantage that a stepping motor which reacts rapidly to control commands can be used to move parts of the device backwards and forwards within, for example, 1 to 3 milliseconds over a path of, for example, 0.5 to 2 mm given a lever arm of, for example, 15 mm.

The pushing or pulling movement of the additional feed dog 23 above the surface of the needle plate takes place against the pressure of the presser foot 34. When the control command is suppressed, the additional feed dog 23, together with the feed dog 11, pushes the workpiece 32 in the workpiece feed direction only.

In the embodiment shown in the drawings, the stepping motor 65, whose control is synchronized by way of a position sensor, may impart a lateral pulling and pushing motion to the additional feed dog 23 by means of the transverse link 31 during each individual revolution of the shaft 2, which movement is superimposed on the feed movement of the additional feed dog 23. As a result, the workpiece 32 can be actively laterally guided and aligned during each revolution of the shaft 2.

The workpiece edge 45 continues to be aligned by the additional feed dog 23 and the guide member 41 until the leading end of the seam or the tape 33 again approaches the needle plate 12.

The foregoing detailed description is given for clearness of understanding only, and no unnecessary limitations should be understood therefrom, as modifications will be obvious to those skilled in the art.

What is claimed is:

1. A drive assembly for a feed dog of a sewing machine, comprising:

a stepping motor for driving said feed dog equipped for reciprocating motion between a first position and a second position;

means for reciprocating said stepping motor between said first and second positions; and transmission elements for transmitting motion of said stepping motor to said feed dog to cause reciprocating lateral motion in said feed dog.

2. A drive assembly for a feed dog of a sewing machine as recited in claim 1, wherein said stepping motor is a two-phase motor.

3. A drive assembly for a feed dog of a sewing machine as recited in claim 2, wherein a direct voltage is supplied to a first phase of said two-phase motor and a current is supplied to a second phase of said two-phase motor, which current is supplied in two drive stages by means of a bistable element controlled by a logic signal input.

4. A drive assembly for a feed dog of a sewing machine as recited in claim 1, wherein said transmission elements comprise:

a crank arm mounted on said stepping motor equipped to rotate with said stepping motor; and a traverse link having a first end pivotally attached to said crank arm and a second end pivotally attached to said feed dog.

5. A drive assembly for a feed dog of a sewing machine, comprising:

a two-phase stepping motor for driving said feed dog having a direct voltage supplied to a first phase of said two-phase motor and a current supplied to said second phase of said two-phase motor in two driver stages;

a bistable element for controlling the supply of current to the stepping motor so as to supply a first current during a first driver stage such that said stepping motor is caused to rotate in a first direction and a second current during a second driver phase such that said stepping motor is caused to rotate in a second direction opposite to said first direction;

a logic signal input to said bistable element for switching between said first and second drive stages; and transmission elements for transmitting motion of said stepping motor to said feed dog to cause reciprocating lateral motion in said feed dog.

* * * * *

UNITED STATES PATENT AND TRADEMARK OFFICE

CERTIFICATE OF CORRECTION

PATENT NO. : 5,051,678

DATED : September 24, 1991

INVENTOR(S) : Gunter Rohr, Wolfgang Norz, and Horst Pordzik

It is certified that error appears in the above-identified patent and that said Letters Patent is hereby corrected as shown below:

On title page, item [73] assignee: delete
"501 Union Special G.M.B.H." and
substitute -- Union Special GmbH -- therefor.

Signed and Sealed this

Thirtieth Day of March, 1993

*Attest:*

STEPHEN G. KUNIN

*Attesting Officer*

*Acting Commissioner of Patents and Trademarks*